US007316605B1

(12) United States Patent
Feng et al.

(10) Patent No.: US 7,316,605 B1
(45) Date of Patent: Jan. 8, 2008

(54) SHEET FOR MOUNTING POLISHING WORKPIECE AND METHOD FOR MAKING THE SAME

(75) Inventors: Chung-Chih Feng, Kaohsiung (TW); I-Peng Yao, Kaohsiung (TW); Chen-Hsiang Chao, Kaohsiung (TW)

(73) Assignee: San Fang Chemical Industry Co., Ltd., Kaohsiung (TW)

( * ) Notice: Subject to any disclaimer, the term of this patent is extended or adjusted under 35 U.S.C. 154(b) by 0 days.

(21) Appl. No.: 11/478,606

(22) Filed: Jul. 3, 2006

(51) Int. Cl.
*B24D 11/00* (2006.01)

(52) U.S. Cl. ..... 451/533; 451/530

(58) Field of Classification Search ..... 451/490, 451/285–289, 526–539, 921
See application file for complete search history.

(56) References Cited

U.S. PATENT DOCUMENTS

| | | | | |
|---|---|---|---|---|
| 3,449,870 | A | 6/1969 | Jensen | |
| 3,453,783 | A | 7/1969 | Queen | |
| 3,860,399 | A | 1/1975 | Noble et al. | |
| 4,132,037 | A | 1/1979 | Bonora | |
| 4,239,567 | A | 12/1980 | Winings | |
| 4,466,852 | A | 8/1984 | Beltz et al. | |
| 5,584,146 | A | 12/1996 | Shamouillan et al. | |
| 5,871,393 | A * | 2/1999 | Shiozawa | 451/285 |
| 5,906,887 | A | 5/1999 | Withers | |
| 5,935,683 | A | 8/1999 | Iiyama et al. | |
| 5,989,470 | A | 11/1999 | Doan et al. | |
| 5,993,293 | A * | 11/1999 | Cesna et al. | 451/41 |
| 6,074,287 | A * | 6/2000 | Miyaji et al. | 451/287 |
| 6,089,965 | A | 7/2000 | Otawa et al. | |
| 6,117,776 | A | 9/2000 | Huber et al. | |
| 6,367,529 | B1 | 4/2002 | Yanagisawa | |
| 6,454,633 | B1 | 9/2002 | Reinhardt et al. | |
| 6,575,821 | B2 * | 6/2003 | Jost | 451/526 |
| 2003/0068967 | A1 * | 4/2003 | Nakamura et al. | 451/527 |
| 2006/0116059 | A1 | 6/2006 | Chen et al. | |

* cited by examiner

*Primary Examiner*—Dung Van Nguyen
(74) *Attorney, Agent, or Firm*—Volentine & Whitt, PLLC

(57) ABSTRACT

The present invention relates to a sheet for mounting a polishing workpiece. The sheet comprises a substrate and a surface layer. The substrate has a surface. The surface layer is located on the surface of the substrate, with no hole structure existing in the interior thereof, and has a plurality of through holes. Accordingly, when the polishing workpiece contacts the surface layer, the air therebetween is vented to the substrate via the through holes and then is easily vented out, without the phenomenon of air wrapping, which increases the adsorption force between the polishing workpiece and the sheet, thereby improving the polishing effect of the polishing workpiece.

5 Claims, 3 Drawing Sheets

SHEET FOR MOUNTING POLISHING WORKPIECE AND METHOD FOR MAKING THE SAME

BACKGROUND OF THE INVENTION

1. Field of the Invention

The present invention relates to a sheet for mounting a polishing workpiece and the method for making the same, and more particularly, to a sheet for mounting a polishing workpiece and the method for making the same which are used in the chemical mechanical polishing process.

2. Description of the Related Art

Polishing generally refers to a wear control for a preliminary coarse surface in the process of chemical mechanical polishing (CMP), which makes the slurry containing fine particles evenly dispersed on the upper surface of a polishing pad, and at the same time places a polishing workpiece against the polishing pad and then rubs the workpiece repeatedly with a regular motion. The polishing workpiece may be objects such as a semiconductor, a storage medium substrate, an integrated circuit, an LCD flat-panel glass, an optical glass and a photoelectric panel. During the polishing process, a sheet must be used for carrying and mounting the polishing workpiece, and the quality of the sheet directly influences the polishing effect of the polishing workpiece.

Referring to FIG. 1, a schematic view of a polishing device with a conventional sheet disclosed in U.S. Pat. No. 5,871,393 is shown. The polishing device 1 includes a lower base plate 11, a sheet 12, a polishing workpiece 13, an upper base plate 14, a polishing pad 15 and slurry 16. The sheet 12 is adhered to the lower base plate 11 through an adhesive layer 17 and is used for carrying and mounting the polishing workpiece 13. The polishing pad 15 is mounted on the upper base plate 14.

The operation mode of the polishing device 1 is as follows. First, the polishing workpiece 13 is mounted on the sheet 12, and then both the upper and lower base plates 14 and 11 are rotated and the upper base plate 14 is simultaneously moved downwards, such that the polishing pad 15 contacts the surface of the polishing workpiece 13, and a polishing operation for the polishing workpiece 13 may be performed by continuously supplementing the slurry 16 and using the effect of the polishing pad 15.

Referring to FIG. 2, a local schematic view of the sheet of FIG. 1 is shown. The sheet 12 is of a single-layered structure, the material of which is generally PU (polyurethane), a kind of foaming material. The sheet 12 is formed by a wet process, and thus a plurality of continuous foaming holes 121 exists in the interior of the sheet 12. The disadvantage of the sheet 12 is that the slurry 16 tends to be inhaled through the foaming holes 121 during the polishing, which causes a change in the hardness and physical property of the sheet 12, such that the polishing condition needs to be readjusted. Furthermore, the lifetime of the sheet 12 is reduced. In addition, the sheet 12 is formed by the wet process which results in an excessively low planarity, and it is very difficult to achieve a generally uniform thickness above 0.5 mm. Finally, the foaming holes 121 within the sheet 12 cause the phenomenon of air wrapping when the sheet 12 adsorbs the polishing workpiece 13, thus resulting in a poor adhesion and a possible crack during the polishing process as well as an uneven polished surface after the polishing of the polishing workpiece 13.

Consequently, there is an existing need for a sheet for mounting a polishing workpiece and the method for making the same to solve the above-mentioned problems.

SUMMARY OF THE INVENTION

The objective of the present invention is to provide a sheet for mounting a polishing workpiece. The sheet of the present invention comprises a substrate and a surface layer. The substrate has a surface. The surface layer is located on the surface of the substrate, with no hole structure existing in the interior thereof, and has a plurality of through holes. Accordingly, when the polishing workpiece contacts the surface layer, the air therebetween is vented to the substrate via the through holes and then is easily vented out, without the phenomenon of air wrapping, which increases the adsorption force between the polishing workpiece and the sheet, thereby improving the polishing effect of the polishing workpiece.

Another objective of the present invention is to provide a method for making the sheet for mounting a polishing workpiece. The method of the present invention comprises the following steps:

(a) forming a surface layer on a release paper, the surface layer having no hole structure in the interior thereof;

(b) forming a substrate on the surface layer;

(c) drying the surface layer and the substrate;

(d) removing the release paper; and (e) forming a plurality of through holes on the surface layer by utilizing a laser with high energy, and the through holes penetrating the surface layer.

DETAILED DESCRIPTION OF THE INVENTION

Figure 1:
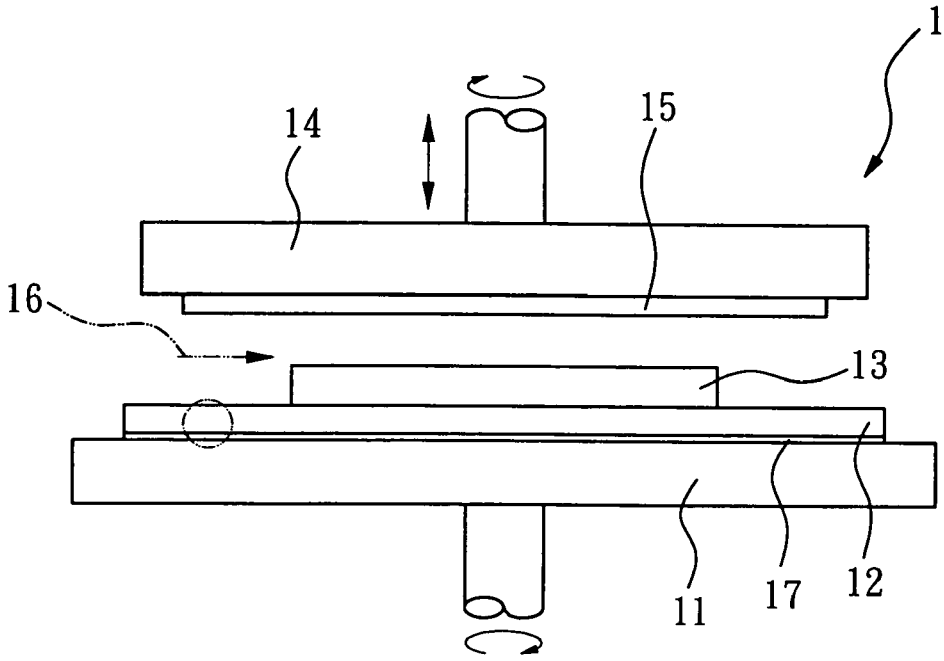
FIG.1 (Prior Art)
FIG. 1 shows a schematic view of a polishing device with a conventional sheet disclosed in U.S. Pat. No. 5,871,393.
Figure 2:
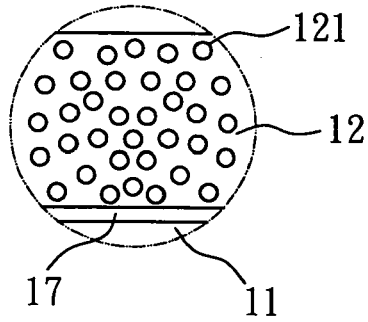
FIG.2 (Prior Art)
FIG. 2 shows a local schematic view of the sheet of FIG. 1.
Figure 3:
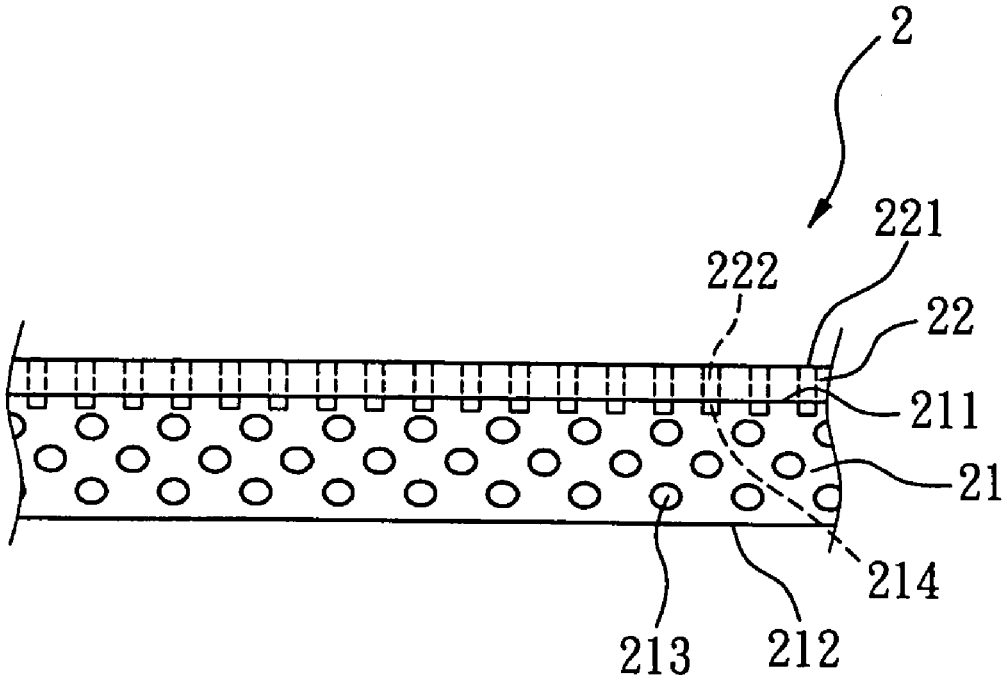
FIG. 3 shows a local schematic view of a sheet for mounting the polishing workpiece according to the present invention.

Referring to FIG. 3, a local diagram schematic view of a sheet for mounting the polishing workpiece according to the present invention is shown. The sheet 2 of the present invention is of a two-layered structure, which comprises a substrate 21 and a surface layer 22. The substrate 21 has a first surface 211 and a second surface 212, wherein the second surface 212 is used for being adhered on the lower base plate (not shown) of a polishing device. In this embodiment, the material of the substrate 21 is high solid PU, with a plurality of continuous or discontinuous type holes 213 existing in the interior of the substrate 21, and the thickness of the substrate 21 can be larger than 0.5 mm. However, it is to be understood that the material of the substrate 21 may also be acrylic resin or another kind of resin.

The surface layer 22 is located on the first surface 211 of the substrate 21, and has a surface 221 and a plurality of through holes 222. The surface layer 22 has no hole structure in the interior thereof. The material of the surface layer 22 is a polymeric elastomer without foam (for example PU, acrylic resin or another kind of resin), and the surface layer 22 has a uniform thickness which is less than that of the substrate 21. The materials of the surface layer 22 and the substrate 21 may be the same or different. The surface 221 of the surface layer 22 is used for carrying and mounting a polishing workpiece (not shown).

When the polishing workpiece contacts the surface 221, the air therebetween may be vented to the substrate 21 via the through holes 222 and then easily vented out, without causing the phenomenon of air wrapping, which increases the adsorption force between the polishing workpiece and the sheet 2, thereby improving the polishing effect of the polishing workpiece. The through holes 222 penetrate the surface layer 22. Preferably, the through holes 222 further extend to the substrate 21. That is, the substrate 21 has a plurality of recesses 214 disposed on the corresponding position of the through holes 222 to be in communication with the through holes 222.

Additionally, since no hole structure exists in the interior of the surface layer 22, the slurry will not be inhaled during the polishing, which can prolong the lifetime of the sheet 2.

The present invention further relates to a method for making the sheet for mounting a polishing workpiece, which comprises the following steps.

Figure 4:
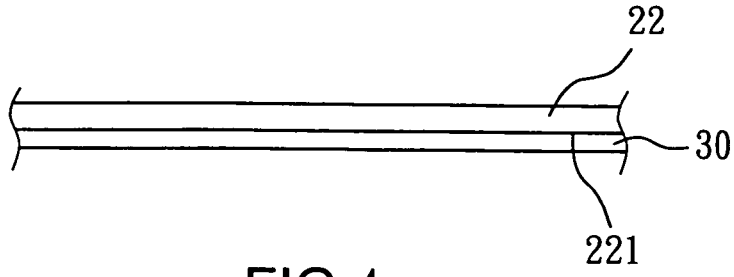
FIGS. 4 to 6 show schematic views of each process step of the method for making the sheet for mounting the polishing workpiece according to the present invention.

At first, referring to FIG. 4, a surface layer 22 is formed on a release paper 30. The surface layer 22 has no hole structure in the interior thereof. The surface layer 22 has a surface 221. The material of the surface layer 22 is a polymeric elastomer without foam (for example PU, acrylic resin or another kind of resin), and the surface layer 22 has a uniform thickness. Preferably, the surface layer 22 is formed on the release paper 30 in a manner of coating.

Figure 5:
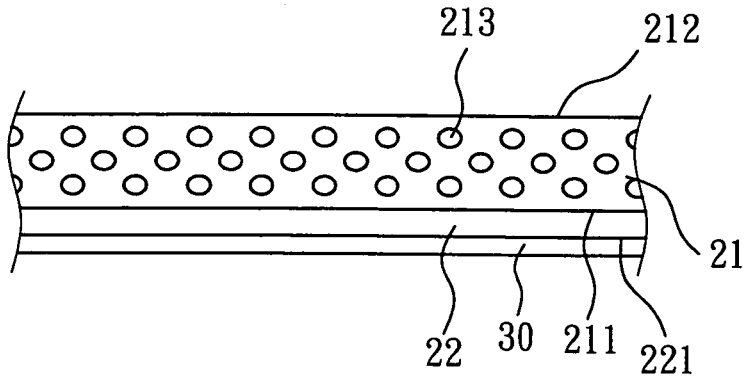

Then, referring to FIG. 5, a substrate 21 is formed on the surface layer 22, and the substrate 21 has a first surface 211 and a second surface 212. In this embodiment, the material of the substrate 21 is high solid PU, with a plurality of continuous or discontinuous type holes 213 existing in the interior of the substrate 21, and the thickness of the substrate 21 is larger than 0.5 mm. However, it is to be understood that the material of the substrate 21 may also be acrylic resin or another kind of resin. The materials of the surface layer 22 and the substrate 21 may be the same or different. Preferably, the substrate 21 is formed on the surface layer 22 in a manner of coating. Therefore, compared with the conventional wet process, the substrate 21 of the invention can remain a uniform thickness when the thickness thereof is larger than 0.5 mm.

Then, the substrate 21 and surface layer 22 are dried for one day. After that, the release paper 30 is removed.

Figure 6:
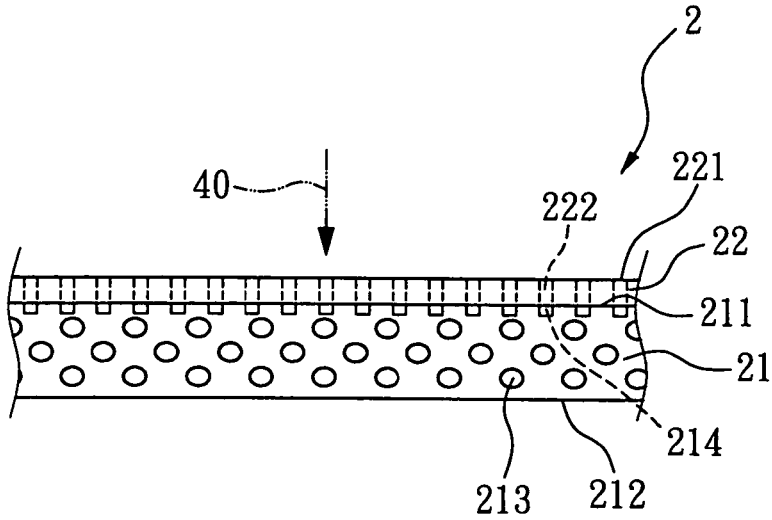

At last, referring to FIG. 6, after turning the substrate 21 and the surface layer 22 upside-down for 180 degrees, a plurality of through holes 222 is formed on the surface 221 of the surface layer 22 by using a laser 40 with high energy. Preferably, the laser 40 with high energy further forms a plurality of recesses 214 on the substrate 21, so as to form the sheet 2 (the same as FIG. 3).

Preferably, a water repellent treatment may also be performed for the surface layer 22 to prolong the lifetime of the sheet 2.

While several embodiments of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and that all modifications which maintain the spirit and scope of the present invention are within the scope as defined in the appended claims.

What is claimed is:

1. A sheet for mounting a polishing workpiece, comprising:

a substrate, wherein a plurality of recesses are located in a surface of the substrate; and a surface layer which is devoid of a hole structure in the interior thereof and which is located on the surface of the substrate, wherein the material of the surface layer is a polymeric elastomer without foam, and the thickness of the surface layer is less than that of the substrate, and wherein the surface layer is adapted for mounting of a polishing workpiece thereon and includes a plurality of through holes extending there through which are aligned with the recesses located in the surface of the substrate, the through holes adapted to vent air between a mounted polishing workpiece and the recesses located in the surface of the substrate.

2. The sheet as claimed in claim 1, wherein the substrate has a plurality of holes in the interior thereof.

3. The sheet as claimed in claim 2, wherein the holes of the substrate are of a continuous type.

4. The sheet as claimed in claim 2, wherein the holes of the substrate are of a discontinuous type.

5. The sheet as claimed in claim 1, wherein the material of the substrate is resin, and the thickness of the substrate is larger than 0.5 mm.

* * * * *